United States Patent [19]

Wirtschafter

[11] 4,361,408

[45] Nov. 30, 1982

[54] TIMER AND ALARM APPARATUS

[75] Inventor: Jonathan Wirtschafter, Minneapolis, Minn.

[73] Assignee: Mediminder Development Ltd., Minneapolis, Minn.

[21] Appl. No.: 949,800

[22] Filed: Oct. 10, 1978

[51] Int. Cl.[3] ..... G04B 47/00; G04F 8/00; G08B 1/00

[52] U.S. Cl. ..... 368/10; 368/109; 368/250; 222/638; 221/2; 340/309.4

[58] Field of Search ..... 58/12, 13, 19 R, 19 C, 58/21.11, 21.13, 21.15 S, 22.7, 22.9, 53, 54, 74, 88 R, 23 BA, 38 R, 39.5, 145 R, 152 R, 152 B; 328/129; 206/528; 222/70; 364/569, 705, 708

[56] References Cited

U.S. PATENT DOCUMENTS

| | | | |
|---|---|---|---|
| 3,395,829 | 8/1968 | Cogdell et al. | 221/15 |
| 3,745,761 | 7/1973 | Tsuruishi | 58/38 R |
| 3,788,059 | 1/1974 | Spadini | 58/23 BA |
| 3,991,554 | 11/1976 | Somogyi | 58/23 BA |
| 4,006,840 | 2/1977 | Shannon | 222/70 X |
| 4,027,470 | 6/1977 | Friedman | 58/39.5 |
| 4,073,133 | 2/1978 | Earls et al. | 58/13 |
| 4,080,575 | 3/1978 | Miki | 328/129 |
| 4,124,146 | 11/1978 | Sealfon | 222/70 |
| 4,131,855 | 12/1978 | Hamagawa | 328/129 |
| 4,144,706 | 3/1979 | Willis | 58/57.5 |

FOREIGN PATENT DOCUMENTS

| | | | |
|---|---|---|---|
| 1904420 | 11/1970 | Fed. Rep. of Germany | 58/152 R |
| 2426831 | 2/1976 | Fed. Rep. of Germany | 58/152 B |

*Primary Examiner*—Vit W. Miska
*Attorney, Agent, or Firm*—Steven G. Parmelee

[57] ABSTRACT

A timer and alarm apparatus suitable for complementary use with medication containers or other similar vessels. The timer includes an electronic elapsed time measuring unit and a display unit for indicating the elapsed time, an interval set unit for presetting a desired time period, an alarm unit to signal the conclusion of the preset interval and a reset unit to reinitiate the measurement of elapsed time. The timer also includes a unique capsule-shaped housing and includes an elastic strip for disposition about an appropriate container. The reset unit may be automatically responsive to the periodic dispensation of the contents of the container.

6 Claims, 8 Drawing Figures

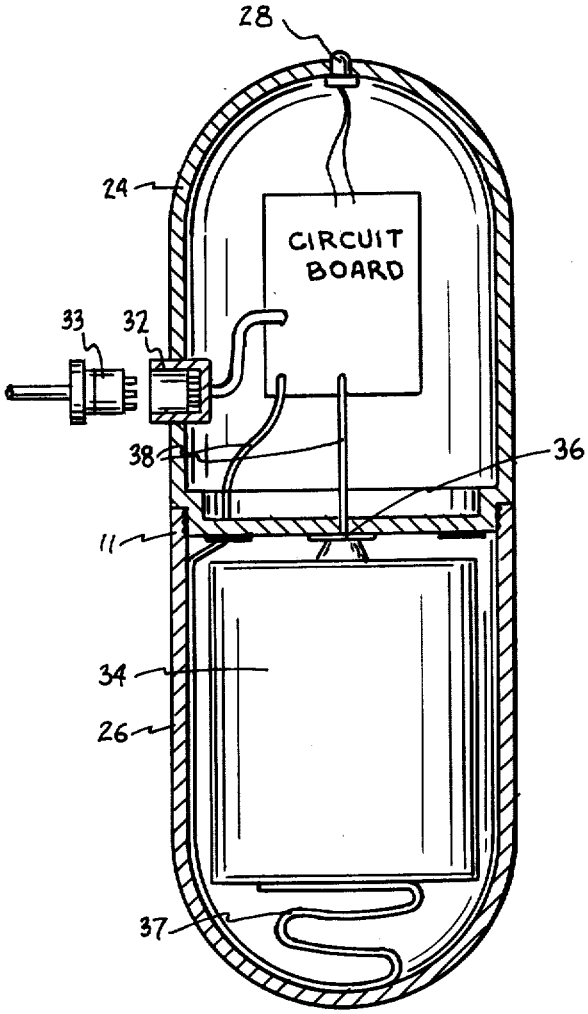
FIG. 3
FIG. 4
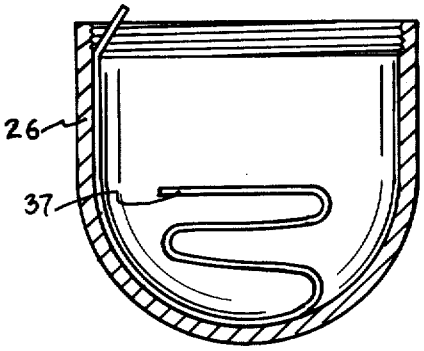
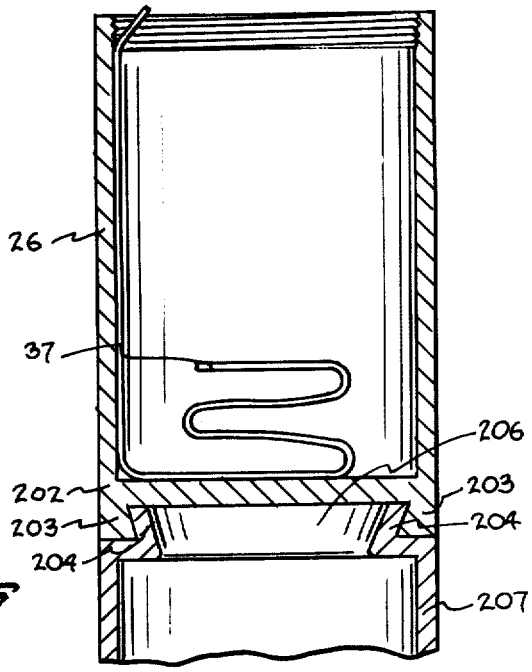
FIG. 5
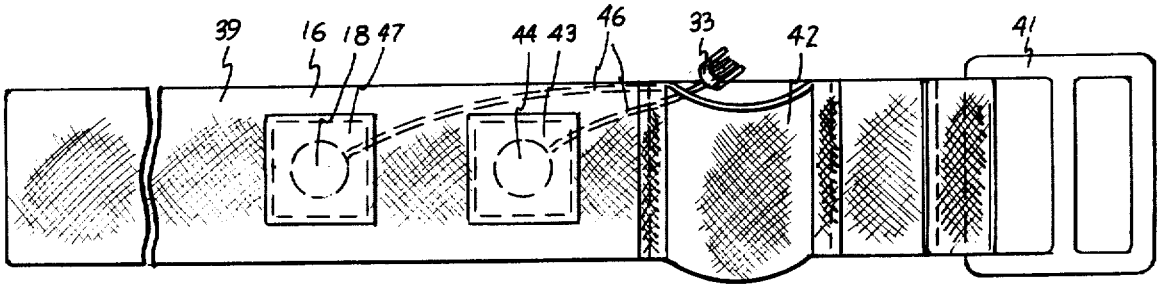
FIG. 6

TIMER AND ALARM APPARATUS

TECHNICAL FIELD

This invention relates generally to the area of electronic timing devices, and more particularly to electronic timer and alarm apparatus used in the periodic dispensation of medications.

BACKGROUND ART

Many drugs and medications currently prescribed by physicians require periodic administration. That is, the medication must be taken at prescribed time intervals. If the patient ignores such instructions and repeats his dosage too frequently, he runs the risk of an overdose. Similarly, if the patient should forget to administer the medication at the proper time intervals, the concentration of medication in his body may become too low. Therefore, certain time-keeping responsibilities are clearly imposed when taking a medication. This time-keeping responsibility falls of necessity upon either the patient or those who care for him. With regard to the latter, the responsibilities are aggravated if more than one person is caring for the patient, such as in a family or institutional setting. The multiple attendants must properly communicate with one another or confusion may result as to when the medication was last administered. This again may lead to under or over dosage.

Perhaps the most common method of meeting this responsibility is to note the current time on a watch or other standard time-keeping device, and to calculate the time at which the next medication must be taken. The patient or attendant then administers the medication and commits the calculated time to memory. When that later time arrives, the patient or attendant then re-administers the medication and the process is repeated.

Although a number of disadvantages are obvious in this prior art method, the most critical disadvantage is placing reliance upon the memory of either the patient or the caretaker. Further errors may be introduced if the calculation of the future time is incorrect. These problems become particularly acute with patients whose mental or physical condition make them less capable of reliably discharging such actions, or, as mentioned above, where a number of persons are responsible for the patient.

The prior art sought to alleviate these problems by following two separate paths of thought. The first path involves the development of medications that do not rely upon either the patient or his attendants for proper periodic administration. For instance, there are various drug release wafers characterized by membranes implantable within the patient's body that periodically release the required dosage. To date, both the development of such medications and the resultant product have been quite expensive. Also, some degree of inconvenience is necessitated by the requirement of subsequent implants. Furthermore, this technology is unsuitable for situations where the patient must be on medications for undeterminable periods.

The second path taken by the prior art has involved the use of devices designed to either minimize the mental calculations involved and/or to operate as reminder devices. Typical of such devices is the pocket chronometer and pill container disclosed in United States Pat No. 2,853,182. This patent shows a small pill case having a timer and alarm built into it, such that when the alarm sounds, the patient will be alerted and act accordingly. Other reminder type devices include containers having an integral recordation system for passively denoting the most recent administration of the medication.

A number of problems are either left unresolved by the prior art, or newly created thereby. Some or all of the prior art devices and methods suffer the following deficiencies:

(1) No notice is given of missed medications;

(2) The devices are relatively complicated to operate and may confuse the limited faculties of an ill person;

(3) The more reliable and comprehensive devices tend to be relatively expensive;

(4) There must be a conscious effort upon the part of the patient or caretaker to painstakingly recalculate and reset the reminder portion of the device, and more frequently than not, this conscious effort must be separate from the act of dispensation;

(5) Many of the devices are ill-suited for medications requiring more than 24 hours between dosages;

(6) Many of the devices do not account for the realities of proper medicinal administration; i.e., that the new time interval should begin only when the medication is taken, even if the most recent medication were taken late; and (7) Many of the devices are not compatible with currently available pill containers, providing instead their own integral compartments which may give rise to problems of pill contamination, mixing and accumulative toxidity;

DISCLOSURE OF INVENTION

The instant invention is directed towards a timer and alarm apparatus that is suitable for complementary use with medication containers and other similar vessels. This is achieved by providing a cylindrically shaped housing that is attachable to a container by the use of an elastic strap or the like. The housing contains an elapsed time counting unit and a display unit, such as an LCD display, for displaying the elasped time count. An interval set unit is included to allow the operator to enter a pre-set time interval. Finally, an alarm unit is provided to cyclically signal the operator when the count of elapsed time equals or exceeds the pre-set time interval.

A reset switch is included to reinitiate the count of elapsed time. Since the alarm sounds in a cyclical fashion, an indicator unit is provided to notify the operator that the reset switch has not been activated. Ideally, the indicator unit is a low power consumption element. This is achieved by having the display unit supplement its function by serving as the indicator unit indicia.

A squelch unit is also included to allow the audible alarm to be "squelched" or silenced before it sounds. The squelch unit does not interfere with the operation of the indicator unit.

Though the display unit disclosed herein provides for the display of 99 hours and 59 minutes, the elapsed time counting unit is not so limited. To avoid any ambiguity, a maximum hours indicator unit is included to notify the operator that the count of elapsed time has exceeded 99 hours and 59 minutes.

The housing described above is usable with a variety of different sized power cells, and thereby offers the operator great flexibility in matching the "life" of the counting and alarm function to a given application.

By providing such an apparatus, the problems noted in the discussion of the prior art are largely alleviated. In particular, the apparatus provides a relatively inexpensive, reliable and simple-to-operate time-keeping and alarm unit well-suited for use with medications and the like that must be adminstered periodically.

BRIEF DESCRIPTION OF DRAWINGS

The advantages of the instant invention will become more obvious upon reference to the following detailed description of the invention, and particularly when taken in conjunction with the appended drawings, wherein;

FIG. 3 is a front elevational sectional view of the apparatus;

FIG. 4 is a front elevational sectional view of a smaller battery compartment for use with the apparatus;

FIG. 5 is a front elevational sectional view of a bottle cap battery compartment;

FIG. 6 is a front elevation of an elastic strap suitable for use with the apparatus;

BEST MODE FOR CARRYING OUT THE INVENTION

Figure 1:
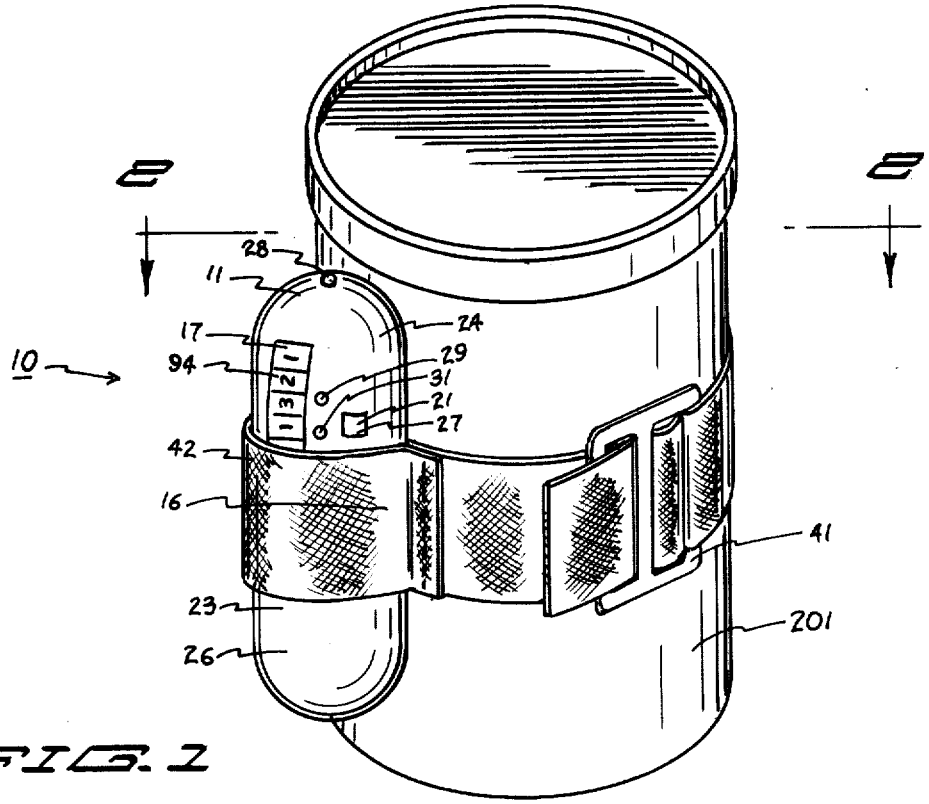
FIG. 1 is a perspective view of an apparatus of the invention disposed about a suitable container.
Figure 7:
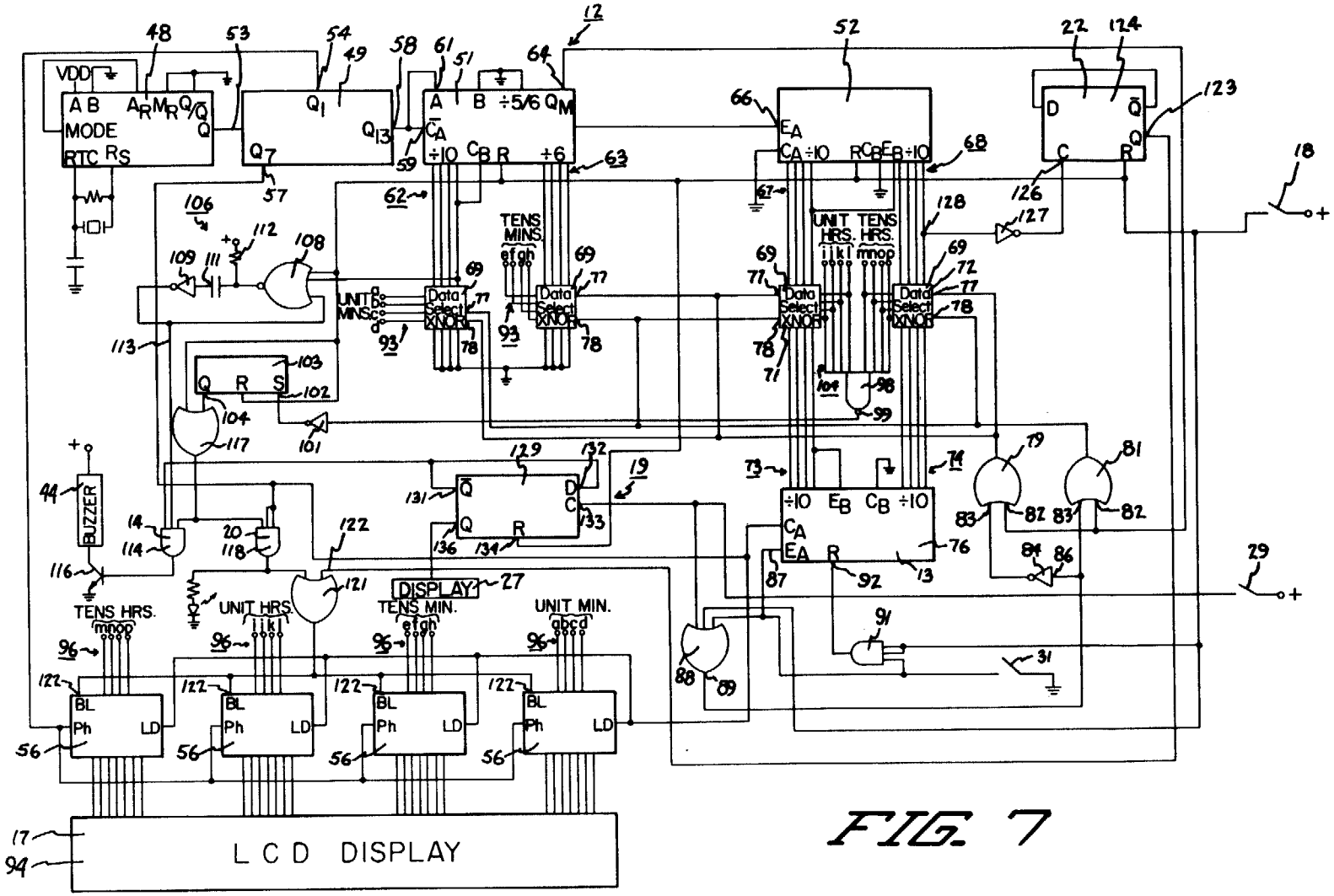
FIG. 7 is a logic diagram of the circuitry.

Referring now to the drawings, and in particular to FIGS. 1 and 6, the apparatus may be seen generally as denoted by the numeral 10. More particularly, the apparatus (10) includes a housing (11) (FIG. 1), an elapsed time measurement unit (12) (FIG. 7), an interval set unit (13), an alarm unit (14), a container attachment unit (16) (FIG. 1), a display unit (17), a reset switch (18), a squelch unit (19), an indicator unit (21) and a maximum hours indicator unit (22) (FIG. 7). These general elements will now be described in detail.

With specific reference to FIG. 1, the housing (11) is a unique cylindrically-shaped container (23). The housing (11) may be fabricated of plastic or other suitable material and includes a top section (24) and a bottom section (26).

The top section (24) includes two openings through which the display unit (17) and a squelch display indicia (27) may be viewed. The top section (24) also provides a housing for the elapsed time measurement unit (12), the interval set unit (13), the indicator unit (19), and the reset circuitry, exclusive of the reset switch (18). An LED (28) is mounted on the very top of the housing (11) and will be described more fully below. A squelch switch (29) and an hours set switch (31) are provided proximal the display unit (12). Finally, the top section (24) is fitted with an electrical female plug (32) (FIG. 3), the internal connections of which will be described further below. This female plug (32) is designed for complementary use with a male plug (33) associated with the container attachment unit (16) (also described below).

The bottom section (26) is threadably coactable with the top section (24) and includes a hollow interior suitable for the reception of an appropriately sized power cell (34). The power cell (34) is spring biased and disposed between a positive contact strip (36) and a negative contact strip (37). The positive (36) and negative (37) contact strips are connected via conductors (38) to the top section (24), such that the circuitry contained therein may be energized by the power cell (34).

With reference to FIG. 4, the bottom section (26) may be of smaller dimensions for use with smaller power cells, if desired. Aside from length, the structure is similar to that of the bottom section (26) described above. In the same fashion, larger power cells could be accomodated by increasing the size of the bottom section (26).

Referring now to FIG. 6, the container attachment unit (16) consists of a strap (39) coactable with the housing (11). The strap (39) is made of elastic material and includes an appropriate loop or fastener (41) for adjusting its length to suit various sized containers. The strap (39) also includes a first compartment or pocket (42) for reception of the housing (11) and a second compartment (43) for disposition about an alarm buzzer (44). These compartments may be provided by small flexible straps that are sewn or otherwise connected onto the strap (39). The male plug (33) mentioned briefly above is affixed to this strap (39) in proximity to the housing compartment (42), such that the male plug (33) operably contacts the housing female plug (32) when the housing (11) is disposed within the housing compartment (42) of the strap (39). The alarm buzzer (44) and a reset switch (18) connect to the appropriate circuitry within the housing (11) by means of conductors (46) embedded within or affixed upon the strap (39) and operably connected to the male plug (33). Finally, the strap (39) includes a third compartment (47) for the reception of a reset switch (18), which compartment (47) is optimally located distal to the housing compartment (11). The purpose of this positioning will be made clear below.

With reference to FIG. 7, the elapsed time measurement unit (12), the interval set unit (13), the alarm unit (14), the display unit (17), the reset switch (18), the squelch unit (19), the indicator unit (20) and the maximum hours indicator unit (22) will now be disclosed. These elements will first be described with reference to the logic embodiment of FIG. 7 and then with reference to the schematic embodiment of FIG. 8.

The elapsed time measurement unit (12) which will be disclosed first, includes generally an oscillator (48), a Binary Counter (49), and first and second Time-Keeping Registers (51 and 52). Beginning with the oscillator block (48) (FIG. 7), an oscillator (48) is provided that will oscillate typically at a pre-selected frequency, with the output signal (53) being pre-scaled and directed to a Binary Counter (49) operating as a frequency divider.

A first output (54) of this Binary Counter (49) provides a signal of approximately 64 Hertz and connects to four LCD Driver units (56) in order to provide reverse phasing therefore. (It is desirable to reverse phase LCD elements as such elements will tend towards an undesirable electroplating action in the presence of unipolar signals.) These LCD Driver units (56) are part of the display unit (17) and will be more fully described below. A second Binary Counter output (57) provides a signal of approximately one part per second. This signal is operably connected to the LCD Driver units (56) and to an Internal Register, all of will be described in more detail below. Finally, a third output (58) produces a signal of one part per minute, which signal is operably connected to the Time-Keeping Register (51). More particularly, this output (58) connects to the clock input (59) and the multi-vibrator input (61) of the first Time-Keeping Register (51).

The first Time-Keeping Register (51) has a first set of outputs (62) providing a binary coded count of minutes and a second set of outputs (63) providing a binary coded count of tens-of-minutes. Additionally, the first Time-Keeping Register (51) includes a multi-vibrator output (64) which output (64) is connected to the control inputs of four Data Select Exclusive NOR Gate units, also to be disclosed in detail below.

A second Time-Keeping Register (52) is operably connected through its enablement gate (66) to the first Time-Keeping Register (51), and provides a first set of outputs (67) yielding a binary coded count of hours and a second set of outputs (68) yielding a binary coded count of tens-of-hours.

Describing now the interval set unit (13) each set of binary coded outputs (62, 63, 67 and 68) for the two Time-Keeping Registers (51 and 52) connects to a Data Select Exclusive NOR Gate unit (69). As a result, there is one Data Select Exclusive NOR Gate unit (69) corresponding to each division of time measurement; that is, one unit (69) for the minutes count, a second unit (69) for the tens-of-minutes count, a third unit (69) for the hours count and finally a fourth unit (69) for the tens-of-hours count.

The two Data Select Exclusive NOR Gate units (71 and 72) connected to the second Time-Keeping Register (52) are also connected to the corresponding outputs (73 and 74) of an Interval Register (76). The binary coded outputs (73 and 74) from this Interval Register (76) correspond to the time interval desired between the initiation of the timing function and the activation of the alarm unit (14). Further attributes of the Interval Register (76) will be disclosed where relevant below.

Each of the four Data Select Exclusive NOR Gate units (69) includes a pair of control inputs (77 and 78). These inputs (77 and 78) control the data available at the output, and also control the Exclusive NOR function. The first control input (77) from each pair is connected to the first control input (77) of the other units (69). The second control inputs (78) are similarly connected in common. Each of these two common bars is connected to the output of a separate control OR gate (79 and 81). Each of the two control OR gates (79 and 81) required has a first and a second input (82 and 83) with the first input (82) of each connected together and to the multivibrator output (64) of the first Time-Keeping Register (51). The remaining two inputs (83) are connected through an inverter (84). The common side (86) of this inverter (84) operably connects to the hours set switch (31), the reset switch (18) and the squelch unit (19), which will be described below. The two control OR gates (79 and 81) and the inverter (84) cooperate to control the data selection of the Data Select Exclusive NOR Gate units (69), such that the units (69) will either all be selecting data from the two Time-Keeping Registers (51 and 52), or they will be selecting data from the Interval Register (76). This control network also controls the Exclusive NOR function of the Data Select Exclusive NOR Gate units (69).

To allow the interval duration to be displayed and selectively changed, an hours set switch (31) is included. The hours set switch (31) connects both to the enabling input (87) of the Interval Register (76) and to the input of an interval display control OR Gate (88). The output (89) of this OR gate (88) connects to the Data Select Exclusive NOR Gate unit's control inputs (77 and 78) as described above. When the hours set switch (31) is on, the interval display control OR gate (88) will cause the Data Select Exclusive NOR Gate unit (69) to display the interval data contained by the Interval Register (76) and simultaneously the operative elements disclosed above will enable and advance the Interval Register's (76) count until the desired interval duration is displayed on the LCD Display unit (17). At that moment, the hours set switch (31) is released, and that particular interval duration will remain recorded in the Interval Register (76).

To allow resetting of the Interval Register (76), the hours set switch (31) is also connected to the input of And gate (91), the remaining input of which is connected to the reset switch (18). The output from this AND gate (91) is connected to the reset input (92) of the Interval Register (76). Therefore, when both the reset switch (18) and the hours set switch (31) are on, the AND gate (91) will produce a high signal and thereby reset the Interval Register (76).

Referring now to the display unit (17), each of the four Data Select Exclusive NOR Gate units (69) provides a set of binary coded outputs (93) corresponding to the appropriate time division for the Time-Keeping (51 and 52) and Interval Register (76) to which that unit is attached. Those BCD outputs (93) connect directly to the LCD Drivers (56), there being one Driver (56) for each division of time measurement (i.e., minutes, tens-of-minutes, hours and tens-of-hours). The display unit (17) also includes an LCD display (94) of a type well-known in the prior art, and no great explanation thereof need be given here. The LCD Drivers (56) are of a type suitable to convert the binary code input (96) into a seven segment output (97) such that a standard numerical display is rendered thereby. Since four LCD Drivers (56) are provided, the LCD display (94) may accommodate all four divisions of time measurement provided by the elapsed time measurement unit (12), such that time will be displayed by four digits representing tens-of-hours, hours, tens-of-minutes and minutes.

The alarm unit (14) and the indicator unit (20) will now be described. The outputs (93) for the Data Select Exclusive NOR Gate units (71 and 72) corresponding to the second Time-Keeping Register (52) and the Interval Register (76) are each individually connected to a single NAND Gate (98). The output (99) of this NAND Gate (98) is connected to the input of an inverter (101), the output of which is connected to the set input (102) of an interval coincidence flip-flop (103). The Q output (104) from this flip-flop (103) operably connects to both the alarm unit (14) and the indicator unit (20).

The inverter (101) connected to the input (102) of the interval coincidence flip-flop (103) will only operate to set the flip-flop (103) when the input (102) thereto is low. Since the input (102) is supplied by the Interval Register NAND Gate (98), it becomes clear that all of the inputs (104) of the NAND Gate (98) must be high in order for the NAND Gate (98) to supply a low signal. In turn, the logical state of each input (104) to the NAND Gate (98) is controlled by the respective Data Select Exclusive NOR Gate unit outputs (93). When the Data Select Exclusive NOR Gate unit (69) is functioning as an exclusive NOR, each of the corresponding outputs (93) between the Time-Keeping Register (52) and the Interval Register (76) will be compared at the input of an exclusive NOR Gate. As is well-known, an output will only result therefrom if both inputs are identical. All of the inputs (104) to the NAND Gate (98) controlling the interval coincidence flip-flop (103) will not be high unless all of the individual exclusive NOR Gates produce a high. Therefore, all of the corresponding outputs between the Time-Keeping Register (52) and the Interval Register (76) must coincide, and this represents that point in time when the elapsed time equals the predetermined time interval. When this occurs, the interval coincidence flip-flop (103) sets and remains set until reset. As will be disclosed below, a reset of this flip-flop (103) will not occur until the reset switch (18) is activated. This is important, since the Time-Keeping Registers (51 and 52) will continue to measure elapsed time, thereby again creating a high signal at the output (99) of the NAND Gate (98), and if the flip-flop (103) were not included, the alarm enabling signal would likewise be halted.

The alarm unit (14) also includes a delay network (106). The first Time-Keeping Register (51) is connected to a delay network (106) containing a NOR gate (108), an inverter (109), a capacitor (111) and a resistor (112). The output (113) of this delay network (106) connects to the input of an alarm unit AND gate (114), the output of which is connected to the base of a driving transistor (116). The emitter of this transistor is grounded, and the collector connects to the alarm buzzer (44) or other alarm-sounding device. Another input to the alarm unit AND Gate (114) connects to the output of an interval coincidence flip-flop OR gate (117), the inputs of which connect to the reset switch (18) and to the output of the interval coincidence flip-flop (103). For the buzzer (44) to sound, all inputs to the alarm unit AND Gate (114) must be high, therefore requiring the interval coincidence flip-flop (103) to be set and the delay network (106) to be "on". The delay network (106) itself operates to allow the buzzer (44) to sound for approximately three seconds every ten minutes. By so limiting the buzzer (44), the operable life of the power supply may be extended at no great compromise to the effectiveness of the apparatus (10).

Describing now more particularly the indicator unit (20), the output of the interval coincidence flip-flop OR gate (117) is also connected to the input of an indicator unit AND gate (118), the remaining input of which is connected to the one part per second output (57) of the Binary Counter (49). The output of this AND gate (118) is connected to an LED network (119) and to an LCD Driver OR gate (121), the output of which is connected to the blanking inputs (122) of the LCD Drivers (56). Consequently, when the interval coincidence flip-flop (103) is set, the indicator unit AND gate (118) will produce a cyclical high output once each second coincidental with the cyclical output of the Binary Counter (49). This high signal is transmitted through the OR gate (121) to the blanking inputs (122) causing the LCD display (94) to blink once each second. In the same fashion, the LED (119) will also blink once each second. This blinking informs the operator that the reset switch (18) has not been activated.

The maximum hours indicator unit (22) will now be described. The remaining input (122) to the LCD Driver OR gate (121) described above is connected to the output (123) of a toggle-wired flip-flop (124), the clock input (126) of which is connected via an inverter (127) to the most significant bit output (128) of the tens-of-hours Time-Keeping Register (52). The purpose of this toggle-wired flip-flop (124) becomes clear upon recalling that only four LCD Displays are provided for. Therefore, the maximum count of elapsed time displayable is 99 hours and 59 minutes. With the passing of the next minute, the display would again read 0000. In order to prevent any ambiguity, and further to indicate to the operator that the elapsed time has now exceeded 99 hours and 59 minutes, the toggle-wired flip-flop (124) is provided to cause the display to blank. To accomplish this, the output (123) from the toggle-wired flip-flop (124) is directed through the LCD Driver OR gate (121) and into the blanking inputs (122) of the LCD Drivers (56) as described above. Therefore, when the toggle-wired flip-flop (124) produces a high, the display will blank and notify the operator that the maximum amount of time has elapsed.

In order to accommodate the patient's cycle, when the patient may wish to skip a dosage in favor of uninterrupted sleep, a squelch unit (19) is provided. This unit (19) centers about a squelch flip-flop (129). The squelch flip-flop (129) is toggle-wired such that the Not-Q output (131) is connected to the data output (132) thereof. Additionally, the clock input (133) is connected to a squelch switch (29), the reset input (134) is connected to the reset switch (18) and the Q output (136) is connected to a display indicia (27). The Not-Q output (131) is also connected to the input of the alarm unit AND gate (114). Consequently, if the squelch flip-flop (129) is set such that a low appears at the Not-Q output (131) thereof, the alarm unit AND gate (114) will not be able to produce a high output to trigger the alarm buzzer (44); the alarm would be squelched. The display indicia (27) noted may be of any type well-known in the prior art. For instance, the indicia (27) might be the word "SQUELCH" as electronically displayed when the squelch flip-flop (129) is set. It is contemplated that this display indicia (27) will be distinct from the LCD numeral display (94) provided by the display unit (17). It should be noted that the squelch unit (19) has no affect upon the operation of the indicator unit (20).

The reset switch (18) noted above is provided to generally reset the initial conditions of the timer and alarm apparatus, and connects to the reset inputs of the toggle-wired flip-flop (124), the squelch flip-flop (129), the two Time-Keeping Registers (51 and 52) and the interval coincidence flip-flop (103). The reset switch (18) is also connected to the input of the interval coincidence flip-flop OR gate (117), the input of the AND Gate (91) connected to the Interval Register reset (92) and to the input of the interval display control OR gate (88).

To summarize the operation of this logic system, assume that initially no time interval is recorded on the Interval Register (76). The operator utilizes the hours set switch (31) as disclosed above to record the appropriate time interval; say, four hours. The operator then engages the reset switch (18), and the interval coincidence flip-flop (103), the toggle-wired flip-flop (124) and the two Time-Keeping Registers (51 and 52) will be reset. The Time-Keeping Registers (51 and 52) will then begin counting time in accordance with the cyclical operation of the oscillator (48) and the Binary Counter (49). Each minute, the multi-vibrator (64) included in the first Time-Keeping Register (51) will activate the Data Select Exclusive NOR Gate unit control inputs (77 and 78) to cause those data selection units (71 and 72) to compare the elapsed time with the interval time. If those times should coincide, indicating that the elapsed time now equals the present interval, the interval coincidence flip-flop (103) will set, and enable the alarm unit (14) for subsequent periodic three second soundings. The interval coincidence flip-flop (103) will also cause the LED network (119) and the LCD display

(94) to blink intermittently as described above. The Time-Keeping Registers (51 and 52) will continue to count elapsed time, the buzzer (44) will continue to sound intermittently, and the LED (119) and the LCD display (94) will continue to blink intermittently until the reset switch (18) is depressed.

To skip a night-time medication, a patient would depress the squelch switch (29). This would set the squelch flip-flop (129) and cause the display indicia (27) to signal that the squelch unit (19) was activated. Simultaneously, the Not-Q output (131) would be locked low, such that the alarm unit AND gate (114) would also be held low. This would prevent the operation of the alarm buzzer (44), and hence the patient would not be disturbed. The squelch flip-flop (129) would not inhibit the operation of the indicator unit AND gate (114), however. Consequently, the LED (119) will flash on and off. Therefore, if the patient should happen to be awake, he will be able to see the blinking light, even in a dark room. (The blinking LCD display (94), of course, would not be visible since ambient lighting is necessary to view such a display). The patient may then arise, take the required dosage, and reset the unit (10) by activating the reset switch (18). Note that the squelch unit (19) may alternatively be reset by depressing the squelch switch (29) a second time (thereby resetting the squelch flip-flop (129)).

Referring now to FIG. 1, a specific circuit realizing the above logic embodiment and utilizing CMOS integrated circuitry will be disclosed. It is to be remembered that this circuit is for an illustrative purpose. In order to provide the electronics in a small enough package to fit within the housing, it might be necessary to reduce this circuit to the confines of a single large scale integrated circuit chip. The methods by which such a reduction is accomplished are well-known in the prior art, and it is not necessary to detail that process herein.

With the foregoing in mind, the prescaled oscillating unit (48) as disclosed in the logic embodiment above is realized herein by an MC14541 Programmable Timer (138) (all part numbers hereinafter referred to identify the parts as manufactured by Motorola). The frequency of the Programmable Timer's (138) oscillation is controlled by an external RC network (139), consisting herein of a 100 k ohm resistor, a 200 k ohm resistor and a 270 micro-farad capacitor.

The output (141) of the Programmable Timer (138) is connected to the clocking input (142) of a 14 Bit Binary Counter (143), represented herein by Motorola part MC14020. This 14 Bit Binary Counter (143) performs the same functions as those described for the Binary Counter (49) above; the Q1 output provides a 64 Hertz signal, the Q6 output provides a one part per second signal and the Q12 output provides a one part per minute signal.

The one part per minute output Q12 is connected to both the clocking input (144) and the multi-vibrator input (145) of a first Industrial Time Based Generator (147) represented herein by an MC14566. This Industrial Time Based Generator (147) performs as the first Time-Keeping Register (51) disclosed above.

The appropriate outputs of this first Time-Keeping Register (147) are connected to the data inputs of first and second Four Bit AND/OR Selectors (148 and 149), represented by two MC14519's. Both Four Bit AND-/OR Selectors (148 and 149) operate as a Data Select Exclusive NOR Gate unit (69) referred to above. Additionally, the multi-vibrator output (151) of the first Industrial Time Based Generator (147) is connected in common to one input each of two OR gates (152 and 153) contained within a Quad Two Input OR Gate chip (154) represented herein by an MC14071. These two OR gates (152 and 153) comprise the Data Select Exclusive NOR Gate unit control OR gates (79 and 81) disclosed above, such that the output of one OR gate (152) connects the B control input of the Data Select Exclusive NOR Gate units (156) and the output of the remaining OR gate (153) is connected to the A control inputs. An invertor (157) (provided by a Sextuple Inverter chip (158) (MC14069)) is also connected between the input of the first OR gate (152) and the input of the second OR gate (153).

The second Time-Keeping Register (52) is a Dual BCD Counter (159) (MC14518). The relevant output (161) of the first Time-Keeping Register (147) is connected to the enable input (162) of this Counter (159). The data outputs of the Counter (159) are connected to third and fourth Four Bit AND/OR Selectors (163 and 164) which form the third and fourth Data Select Exclusive NOR Gate units (156).

The Interval Register (76) is similarly provided for by the use of a second Dual BCD Counter unit (166). The outputs of the Interval Register (76) are connected to corresponding third and fourth Four Bit AND/OR Selectors (163 and 164) in accordance with the teachings of the logic embodiment above.

Each output of the third and fourth Four Bit AND-/OR Selectors (163 and 164) is connected to an Eight Input NAND Gate (MC14068) (167). The output of the NAND (167) is then connected to the input of an inverter (168) (contained within the Sextuple Inverter chip MC14069 (158)). The output of this inverter (168) is connected to the reset input of an interval coincidence flip-flop (169) contained in a Dual Type Flip-Flop chip (MC14013) (171). The output (172) of this interval coincidence flip-flop (169) is then connected to an OR gate (173) contained within the Quad Dual Input OR Gate chip (MC14071) (154) described above. The output of this OR gate (173) connects to the inputs (174 and 176) of two separate AND gates contained within a Tri Three Input AND Gate chip (MC14073) (177).

The output (178) of the first AND gate is connected to the driving transistor (116) of the alarm unit (14), and the output (179) of the second AND gate is connected to a third OR gate (181) contained in chip MC14071 (154). The second AND gate is also grounded through a serially connected resistor and LED network (119). The output of the OR gate (181) is connected to the blanking inputs (122) of all four of the LCD driver units (56) (MC14543) as taught above.

The remaining input to this OR gate (181) is connected to the output of a toggle-wired flip-flop (182) contained in a second MC14013 Dual Type Flip-Flop chip (183). The clock input to this toggle-wired flip-flop (182) is connected to an output of the second Time-Keeping Register (159) via an invertor (184) contained in chip (158). The reset of the toggle-wired flip-flop (182) and the set of the interval coincidence flip-flop (169) both connect to a common output (186) of a Hex Contact Bounce Eliminator (187) (MC14490). The relevant input for this Bounce Eliminator (187) is connected to a reset switch (18). The Bounce Eliminator (187) is provided to prevent any electrical bounce from occurring upon the mechanical closing of the switch (18). (The squelch switch (29) and hours set switch (31) to be described below are also routed through this Bounce Eliminator (187) for the same reason.)

An hours set switch (31), connects to the input (188) of an AND gate contained in the MC14073 chip (177), the remaining inputs (189) of which connect to the reset switch (18). The output (191) of this AND gate is connected to the reset input of the internal register Dual BCD Counter (166). This allows the interval register (76) to be reset when simultaneously closing both the reset switch (18) and the hours set switch (31).

The hours set switch (31) also connects to the input (192) of an OR gate included in a Dual Tri Input OR Gate chip (193) (MC14000). The remaining inputs (194 and 196) to this OR gate are connected to the squelch switch (29) and to the reset switch (18) with the output (197) therefrom connecting to the inputs of the two control OR gates (152 and 153) for the Data Select Exclusive NOR Gate units (79 and 81).

The squelch switch (29) is connected through the Bounce Eliminator (187) (as noted above) to the clocking input of a squelch flip-flop (129) contained in the first Dual Type Flip-Flop chip (171) (MC14013). The reset input for the squelch flip-flop (129) is connected to the reset switch (18). The Q output connects to a separate display unit (now shown) which may be of any type well-known in the prior art. The Not-Q and data outputs are toggle-wired to an input (198) of the first AND gate described above in the MC14073 chip (177).

Figure 8:
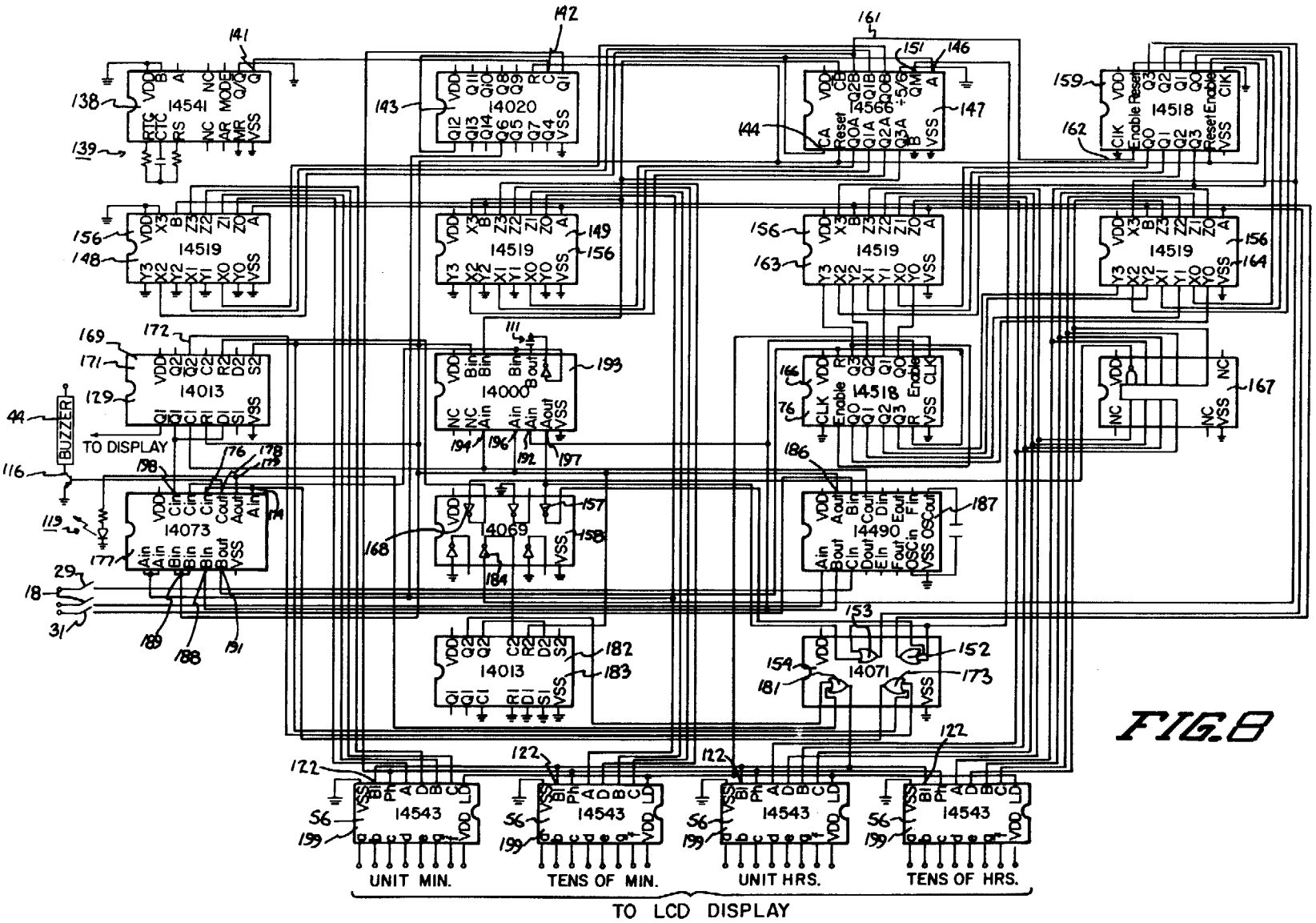
FIG. 8 is an electrical schematic diagram of the circuitry.

The alarm unit delay network (106) disclosed above is provided herein by identical logical units supplied in a MC14000 part (193), the required capacitor (111), and resistor (112) being externally connected thereto (the resistor (112) not being shown in FIG. 8).

Finally, the LCD Driver units (56) are realized by four MC14543 chips (199) which are standard BCD-to-seven-Segment Converter units. The inputs to these drivers (56) connect to the outputs of the Four Bit AND/OR Selectors (156), with the outputs therefrom being connected to a standard LCD display (not shown).

The operation of the timer apparatus (10) will now be disclosed as follows. The housing (11) is equipped with the proper sized power cell (34). The size varies depending upon anticipated usage and convenience. For instance, if it is anticipated that the medication to be taken is to be continually administered over an entire month, a common S76 #1.5 volt hearing aid cell will prove sufficient, assuming the alarm will be active no more than two hours per day. If longer or shorter periods are desired, requiring corresponding cell life, other cells having different operable lives may be provided. Changing to a different sized cell requires only that the bottom section (26) of the housing (11) be of a different dimension.

The housing (11) is then placed snugly within the pocket (42) provided in the attachment strap (39), such that the display unit (17) is visible. The male plug (33) attached to the strap (39) is inserted into the female receptacle (32) provided therefore in the housing (11). Inserting this male plug (33) will operably connect the reset switch (18) and the alarm buzzer (44) to the pertinent circuitry located in the housing (11).

Figure 2:
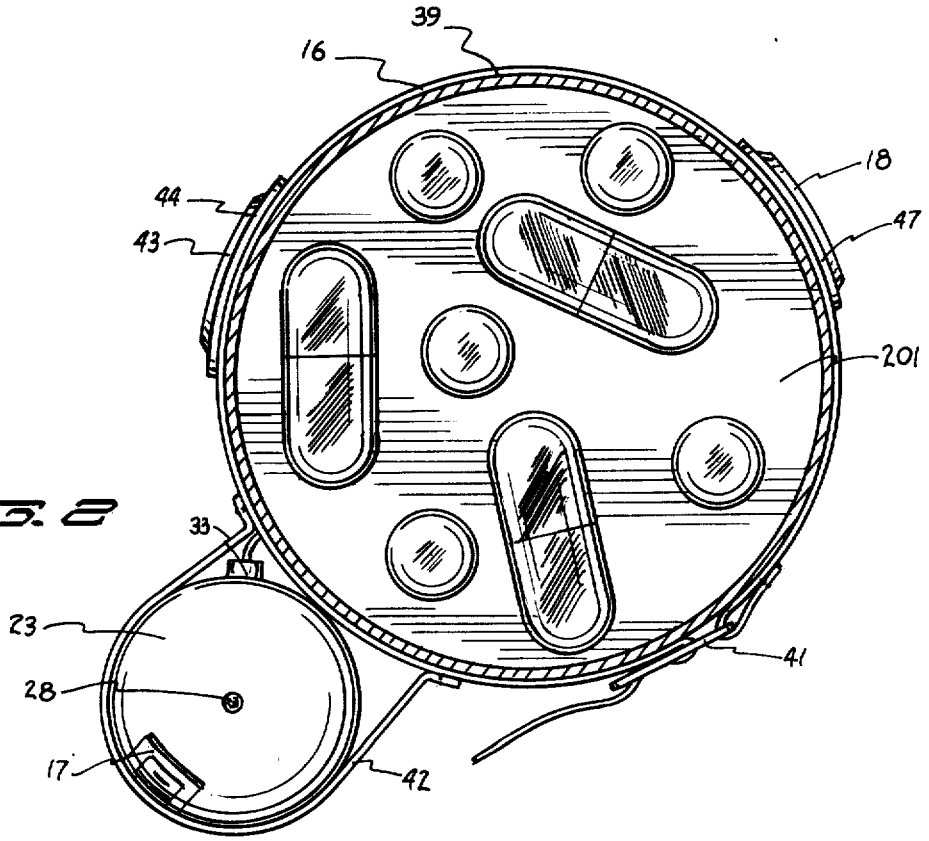
FIG. 2 is a top plan view of the apparatus and container as shown in FIG. 1.

The housing (11) is then placed flush against the side of a medication container (20) (see FIG. 1) and the strap (39) is snugly disposed thereabout. Ideally, the reset switch (18) is located substantially opposite the housing (11), as shown in FIG. 2, although this is not a necessity.

Assuming for purposes of illustration only that the medication is to be taken every four hours, the hours set switch (31) is depressed, thereby coincidentally allowing the Internal Register data to be displayed on the display unit (17). At one second intervals (in keeping with the one part per second pulse provided by the Binary Counter (49) the Internal Register hours will advance. When the display (17) indicates four hours, the hours set switch (31) is released, thereby ceasing the cyclical advance and retaining the count of four hours in reference.

The operator then presses the reset switch (18) and sets the container (201) down. Depressing the reset switch (18) will begin the measurement of elapsed time. When the elapsed time measured equals four hours, the alarm unit (14) and the indicator unit (19) will be activated. More particularly, the alarm buzzer (44) will sound for three seconds every ten minutes to alert the operator that the medication must be administered and the LCD display (94) will blink each second as an indication that the reset switch (18) has not been reset. This will continue until the patient or operator picks up the container (201) in order to dispense the medication. Upon holding the container (201), the reset switch (18) is depressed due to its location. This results in the resetting of the elapsed time measurement unit (12) as well as the resetting of the alarm unit (14), the indicator unit (21) and the squelch unit (19). The patient then administers the medication and awaits the next signaling from the timer apparatus (10). If it is desired to squelch the auidible alarm, the squelch switch (29) may be depressed and the squelch unit (19) will operate to disable the alarm buzzer (44).

If the operator desired to display the preset time interval without disturbing the count of elapsed time (by depressing the reset switch (18)) and without disturbing the interval duration itself (by depressing the hours set switch (31)), he may view it by depressing and holding depressed the squelch switch (29). This will cause the interval to be displayed. To then disable the squelch unit (19), the operator need only depress the squelch switch (29) again.

Since the timer apparatus (10) is designed for attached and conjunctive use with a medication container (201), the possibility of displacement between the two is minimized. Furthermore, once the desired time interval is recorded in the Interval Register (76), the only physical reaction required by the operator to reinitiate the process for the next time interval is to cause the reset switch (18) to be closed. Due to the location of the reset switch (18) in conjunction with the attachment strap (39), even this operation is rendered relatively foolproof. Generally, it should not require a conscious effort upon the part of the operator to reset the timer apparatus (10). The operator need merely grasp the container (201) in order to remove the top therefrom. This pressure should be sufficient to depress the reset switch (18).

If desired, a container (201) specifically designed to accommodate the timer apparatus (10) could be used. The container (201) could include a longitudinal trough disposed thereon, the trough being of a size complementary to the dimensions of the housing (11). This embodiment would insure a stable affixment between the container (201) and the housing (11). Furthermore, it will be obvious to those skilled in the art that various other implements and techniques could be utilized to produce the desired nexus between the housing (11) and the container (20). Also, the housing (11) could be used separately from the container (201).

Another embodiment that may be desirable is illustrated at FIG. 5. The bottom section (26) of the housing (11) is shown having an end piece (202) modified to include snap flanges (203) for complementary use with the snap ring (204) provided on the mouth (206) of the medication container represented by the numeral 207. Such a configuration would allow the housing (11) to be attached to a medication container (207) by snapping the housing (11) onto the mouth (206) of the container (207).

While a preferred embodiment of the invention has been described, it should be understood that various changes, adaptations and modifications may be made therein without departing from the spirit of the invention and the scope of the appended claims.

What is claimed is:

1. Timer apparatus suitable for use with medicine containers or other vessels comprising:
   (a) elapsed time measuring means for measuring elapsed time;
   (b) interval set means for providing a preset time interval;
   (c) display means operably connected to said elapsed time measuring means for displaying measured elapsed time;
   (d) alarm means responsive to said elapsed time measuring means and said interval set means for periodically signaling that the measured elapsed time exceeds the preset time intervals;
   (e) switch reset means operably connected to said elapsed time measuring means for restarting the measurement of elapsed time; and
   (f) indicator means responsive to said elapsed time measuring means, said interval set means and to said switch reset means for periodically signaling that said switch reset means has not restarted the measurement of elapsed time subsequent to the coincidence of measured elapsed time with the preset time interval.

2. The timer apparatus of claim 1 wherein the period of delay between said alarm means signals is of a greater duration than the period of delay between said indicator means signals.

3. The timer apparatus of claim 1 wherein the frequency of periodicity of said indicator means signal is greater than the frequency of periodicity of said alarm means signal.

4. The timer apparatus of claim 1 wherein said switch reset means includes an activating switch that is responsive to certain parameters that evidence dispensation of medicine from a container, such that upon dispensing medicine from said container, said switch reset means will automatically restart the measurement of elapsed time until the next actual dispensation of medicine from said container.

5. Timer apparatus suitable for use in the periodic dispensation of medicine and for use with medicine containers and other vessels, comprising:
   (a) elapsed time measuring means for measuring elapsed time between each actual dispensation of medicine from a container;
   (b) interval set means for providing a pre-set timed interval between scheduled dispensations of medicine from said container;
   (c) display means operably connected to said elapsed time measuring means and to said interval set means for selectively displaying:
      (i) measured elapsed time between actual dispensations of medicine from said container; and
      (ii) the pre-set time interval;
   (d) alarm means responsive to said elapsed time measuring means and said interval set means for signalling that the measured elapsed time exceeds the pre-set time interval and that medicine should be dispensed from said container; and
   (e) switch reset means operably connected to said elapsed time measuring means for restarting the measurement of elapsed time between actual dispensations of medicine from said container, wherein said switch reset means includes an activating switch that is responsive to certain parameters that evidence dispensation of medicine from said container, such that upon dispensing medicine from said container, said switch reset means will automatically restart the measurement of elapsed time until the next actual dispensation of medicine from said container.

6. Timer apparatus suitable for use in the periodic dispensation of medicine and for use with medicine containers and other vessels, comprising:
   (a) elapsed time measuring means for measuring elapsed time between actual dispensations of medicine;
   (b) interval set means for providing a preset timed interval between desired dispensations of medicine;
   (c) display means operably connected to said elapsed time measuring means and to said interval set means for selectively displaying
      (i) measured elapsed time between actual dispensations of medicine; and
      (ii) the preset time interval;
   (d) alarm means responsive to said elapsed time measuring means and said interval set means for signaling that the measured elapsed time exceeds the preset time interval and that medicine should be dispensed;
   (e) switch reset means operably connected to said elapsed time measuring means for restarting the measuring of elapsed time between actual dispensations of medicine; and
   (f) maximum elapsed time indicator means responsive to said elapsed time measuring means for indicating that the measured elapsed time has exceeded a preselected value that relates to said display means' capacity to display measured elapsed time.

* * * * *